US006824017B2

(12) United States Patent
Sluijter

(10) Patent No.: US 6,824,017 B2
(45) Date of Patent: Nov. 30, 2004

(54) BEVERAGE DISPENSING DEVICE, PROVIDED WITH A DUAL CLOSURE

(75) Inventor: Robert Sluijter, Overveen (NL)

(73) Assignee: Heineken Technical Services, B.V., Zoeterwoude (NL)

( * ) Notice: Subject to any disclaimer, the term of this patent is extended or adjusted under 35 U.S.C. 154(b) by 159 days.

(21) Appl. No.: 10/259,653

(22) Filed: Sep. 30, 2002

(65) Prior Publication Data

US 2003/0071067 A1 Apr. 17, 2003

(30) Foreign Application Priority Data

Sep. 28, 2001 (NL) ..... 1019054

(51) Int. Cl.[7] ..... B67B 5/00

(52) U.S. Cl. ..... 222/153.04; 222/105; 222/325; 222/400.7

(58) Field of Search ..... 222/105, 153.04, 222/325, 333, 399, 400.7, 146.6; 220/835

(56) References Cited

U.S. PATENT DOCUMENTS 5,199,609 A * 4/1993 Ash, Jr. ..... 222/325
5,240,144 A * 8/1993 Feldman ..... 222/105
5,526,957 A * 6/1996 Brown et al. ..... 222/105
6,182,863 B1 * 2/2001 Van Der Meer et al. ... 222/105
6,454,131 B1 * 9/2002 Van Der Meer et al. ... 222/399

FOREIGN PATENT DOCUMENTS

WO WO 00/03944 1/2000

* cited by examiner

*Primary Examiner*—Philippe Derakshani
(74) *Attorney, Agent, or Firm*—Young & Thompson

(57) ABSTRACT

A beverage dispensing device, is provided with a cooling chamber (32) that can be closed with a lid (43). A pack (31) can be placed in the cooling chamber, which pack is provided with an air inlet (33) that connects to a connecting element (42) of a pressure line in the lid (43). On closure of the lid (43), by placing a handle (50) in the closing position, the connecting element (42) can be brought into engagement in a tight grip with the air inlet (33), and spring closing elements (51) in the lid are locked without the user having to exert a great force, while an airtight connection is obtained.

15 Claims, 5 Drawing Sheets

BEVERAGE DISPENSING DEVICE, PROVIDED WITH A DUAL CLOSURE

The invention relates to a beverage dispensing device, provided with a chamber having a bottom, a side wall and an aperture on a top side of the side wall for the accommodation of a beverage container, with a lid that is hingedly connected to the side wall and can be placed over the aperture, thereby sealing it, with a pressure device that is connected to a pressure line situated in the lid, and with a connecting element situated on the end of the pressure line, for the purpose of connection to a beverage container on closure of the lid.

Such a beverage dispensing device is known from PCT/NL99/00454. The known dispensing device comprises a cooling chamber, in which a pack with carbonated beverage, such as beer, can be placed. The pack with carbonated beverage comprises an outer container made of plastic and an inner, flexible bag containing carbonated beverage. The flexible bag is connected by way of a filling and dispensing head to the neck of the outer container. The dispensing head is provided with a first, relatively broad filling channel, to which a filling head of a filling line can be connected, for the purpose of filling the flexible bag. After the filling, and after detachment of the filling head from the filling line, the filling channel of the filling and dispensing head is closed by a spring-loaded valve. A second, relatively narrow dispensing channel of the filling and dispensing head is connected to a flexible hose, which extends at right angles to the longitudinal direction of the container. The dispensing channel is also closed by a spring-loaded valve prior to placing of the container in the cooling chamber of the beverage dispensing device. A square plastic outflow part is fixed on the end of the flexible hose, which outflow part is provided with a plate with a brand name on it, and which outflow part can be placed in an accommodation part of the dispensing head of the beverage dispensing device. The dispensing head comprises two hinged parts, which bound a feed-through channel for the flexible hose, and a shut-off valve connected to a tap handle. The shut-off valve comprises a spring-loaded clamping mechanism, which can close off and release the flexible hose in the feed-through channel by operation of the tap handle.

After the flexible hose has been placed in the feed-through channel, the dispensing head is closed, and the tap handle is placed in the closed position. A lid of the dispensing device can then be closed, and pressure means, such as a compressor, can be connected to the container, in order to supply a pressure medium to the area between the wall of the outer container and the flexible bag. On closure of the lid of the cooling chamber of the dispensing device, the dispensing channel of the filling and dispensing head is opened, so that the contents of the flexible bag are pushed into the flexible hose. By opening the tap handle, the flexible hose is released and assumes its free, undeformed cross section, and the carbonated beverage is dispensed under pressure from the dispensing head. The known dispensing device is also provided with a cooler, such as a Peltier element, for cooling the beverage.

In order to ensure good functioning of the dispensing device, it is extremely important for the pressure line and the lid to connect in an airtight manner to the air supply valve and to the side wall of the pack respectively. If the pressure line is not properly connected to the air supply valve, and if the pressure medium leaks along the circumferential wall of the lid, there may be an inadequate build-up of pressure in the container, so that the compressor of the beverage dispensing device will be activated and will go into operation at undesired times. It is also important for a user to be able to open a spring-loaded beer valve of the beverage container with little physical effort on closure of the lid.

It is therefore an object of the invention to provide a beverage dispensing device in the case of which, with the exertion of a relatively slight closing force by the user, the connecting element of the pressure line can be placed in an airtight manner against a container placed in the device.

It is a further object of the invention to provide a beverage dispensing device in the case of which on closure of the lid the spring-loaded beer valve of the beverage container can be opened by the user with little physical effort.

It is likewise an object of the invention to provide a beverage dispensing device with a lid that can be opened and closed in a simple manner, while the pressure line is connected in a reliable way to the container in the device. To this end, the beverage dispensing device according to the invention is characterized in that the lid comprises a spring closing element which, when the lid swings shut, falls behind a fixing part formed on the wall, and also comprises a handle that can swing between a releasing and a closing position, in the case of which, by placing the handle in the closing position with the lid closed, the connecting element is moved by the handle in the direction of the bottom of the chamber and is taken into engagement in a tight grip with an air inlet of the beverage container, and the spring closing element is locked, and by moving the handle to the releasing position with the lid closed, the connecting element is raised from the air inlet, and the spring closing element is moved to a releasing position, in which it comes away from the fixing part.

After a container has been placed in the cooling chamber, the user can close the lid, with the handle now in the releasing position. As the lid swings downwards to close, the spring closing element will first make connection with the fixing part on the wall, so that a first rough closure is obtained. The spring closing element is locked by moving the handle to the closing position while the lid is swinging to the closed position, so that opening of the lid is no longer possible, while the connecting element is pressed against the air connection of the beverage container, so that the lid is placed in a play-free and close-fitting manner against the container and against the wall. Owing to the lever action of the handle, a great downward pressure of the connecting element against the air inlet of the container can be generated with relatively little effort, so that an airtight seal is ensured. When the closed lid is to be opened, the handle is first of all placed in the releasing position, in which said handle engages upon the spring closing element in such a way that the latter comes away from the fixing part. The closing element is also lifted clear of the container by moving the handle, so that the lid can be opened and the container can be removed from the cooling chamber.

In one embodiment, the lid also comprises on the inside an operating lug, which is movable together with the connecting element by the handle, for the purpose of acting upon a spring-loaded shut-off valve of the beverage container. The container, which is composed of, for example, a plastic outer wall containing a flexible bag of the type described in PCT/NL99/00454, comprises a spring shut-off valve that is connected by way of an elbow piece to a flexible hose with a bottle valve on the end. The spring valve is opened by depressing the elbow piece, so that the contents of the container are brought into communication with the dispensing line. During the first closing phase the connecting element of the pressure line is positioned in the correct way, and a stop in the lid is placed on the elbow piece, without the user having to make any physical effort to do this. By operation of the handle during the second closing phase, the lid is pressed downwards against the spring pressure of the container placed in it, in such a way that the spring shut-off valve of the container is opened and the contents of the container can pass into the dispensing line.

In one embodiment, the handle comprises a curved arm with a handle part that can be placed substantially parallel to the lid surface, the lid comprising a recess at the position of the handle part, for the accommodation of the user's fingers. In this way a handle that can be depressed easily by the user is formed, the curved arm sliding along a locking pawl on the wall of the container, and in this way pushing the lid into a connection in a tight grip with a container placed in the dispensing device, and with the wall, so that no air can leak out of the pressure line, and so that the dispensing valve is fully opened. The lid can preferably be opened independently of a shut-off valve that is fixed on the wall of the container, the shut-off valve being provided with a tap handle and an operating mechanism for opening and closing the shut-off valve placed at the end of the flexible dispensing line of the container.

An embodiment of a beverage dispensing device according to the invention will be explained in greater detail with reference to the appended drawings, in which.

Figure 4A:
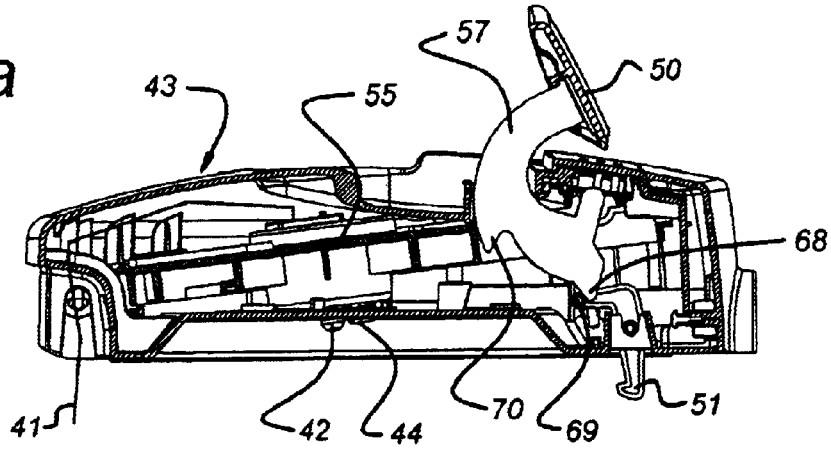
Figure 4B:
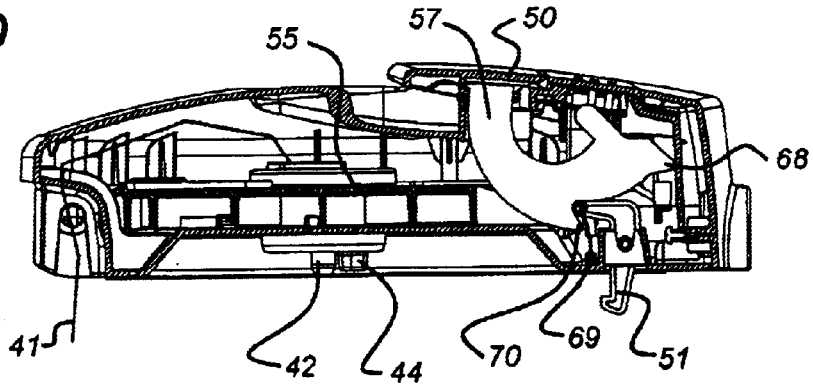
Figure 4C:
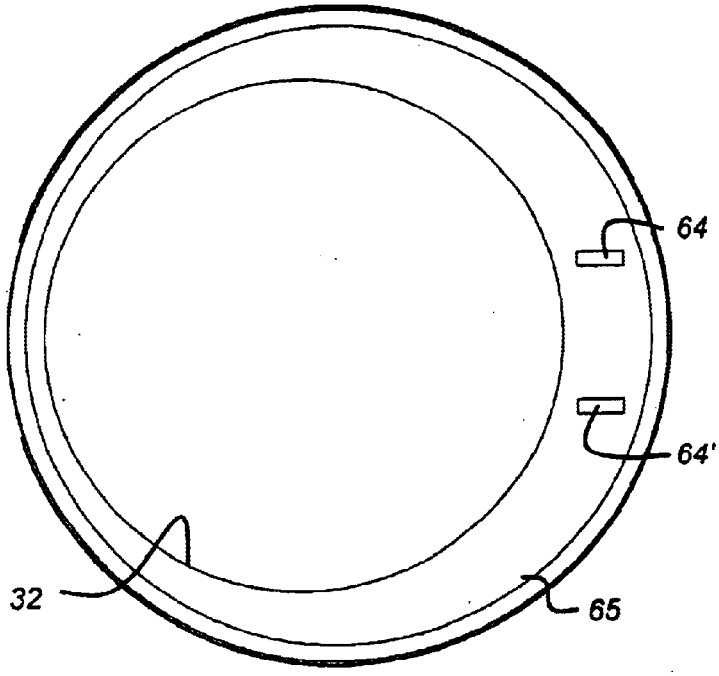
Figure 5:
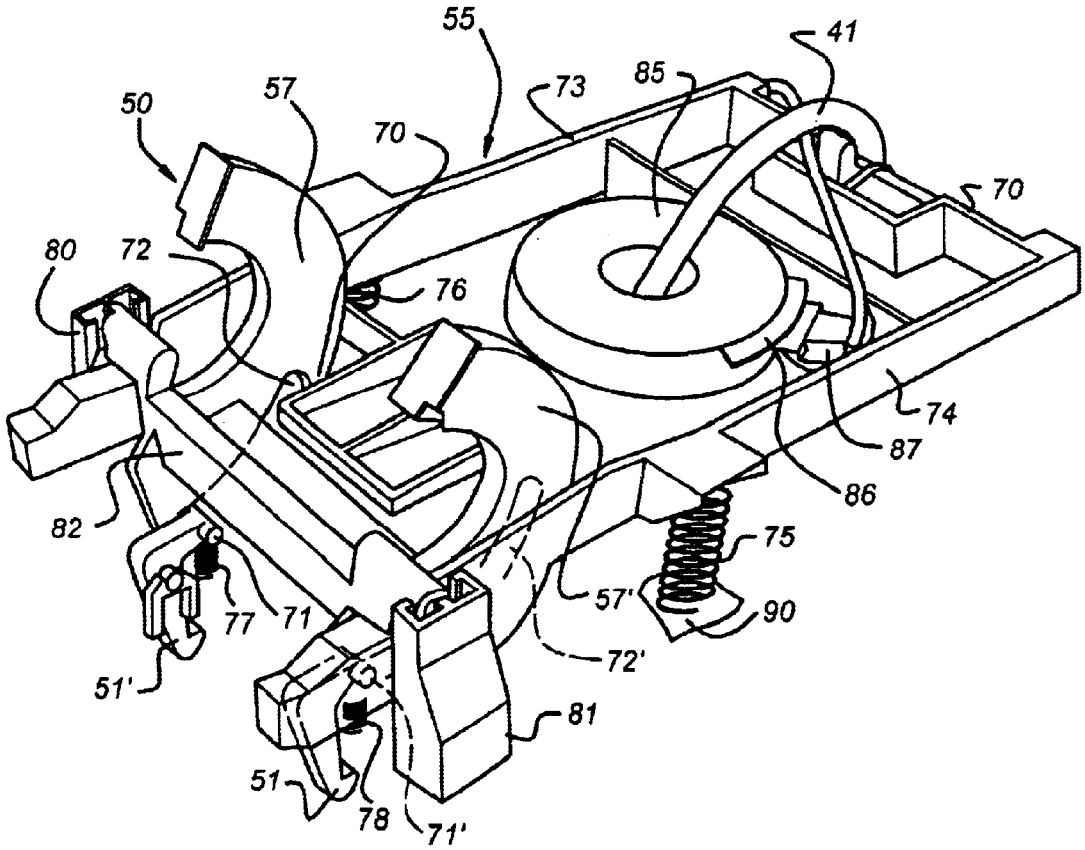

FIGS. 4*a*, 4*b* and 4*c* show a cross section of the lid in the closed position, in which the handle is situated in the releasing position and in the closing position respectively, and a top view of the cooling chamber; and FIG. 5 shows a perspective view of the movable bridge in the lid.

Figure 1:
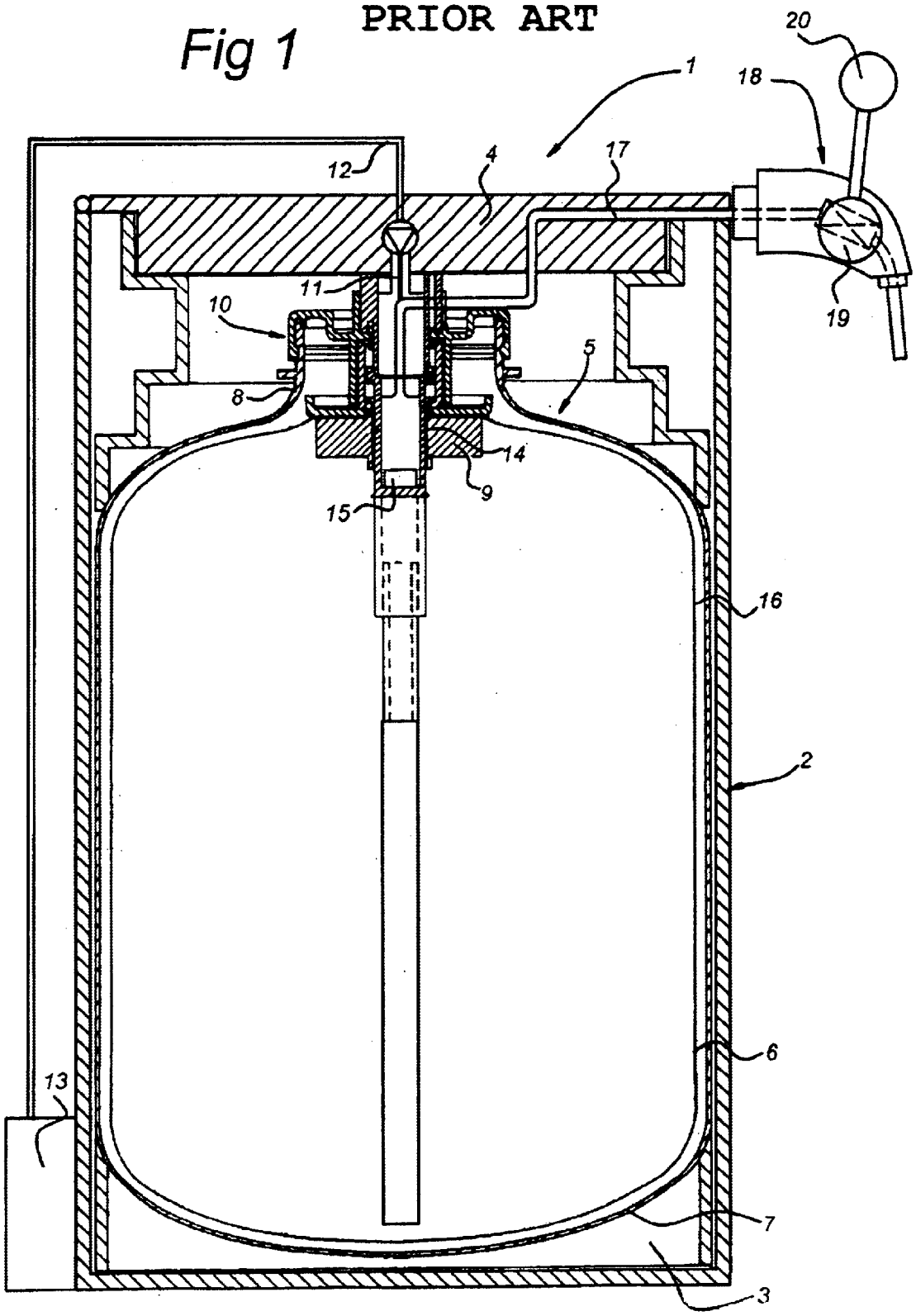
Fig 1 PRIOR ART
FIG. 1 shows a beverage dispensing device according to the prior art.

FIG. 1 shows a beverage dispensing system 1, having a dispensing device 2 provided with a cooling chamber 3 that can be shut off by a lid 4. A pack 5 with carbonated beverage is placed in the cooling chamber 3. The carbonated beverage in the embodiments described below is beer, which is accommodated at an excess pressure of between 0 and 3 bar, for example 1 to 1.5 bar (the equilibrium pressure of $CO_2$ above beer), in a flexible bag 6 of the pack 5. The pack may, however, also contain other carbonated or non-carbonated beverages, such as soft drinks, at pressures generally lying in the excess pressure range between 0 and 5 bar.

The flexible bag 6 is accommodated in an outer, rigid container 7 of the pack 5, and near a neck is fastened to a flat lip 9 of a filling and dispensing head 10. The filling and dispensing head 10 comprises an air channel 11, which can be connected to a pressure line 12 in the lid 4, which pressure line is connected to a compressor 13. Instead of a compressor, another pressure means may also be used, such as a pre-compressed gas, for example compressed air or pressurized $CO_2$, supplied from a separate cylinder. On closure of the lid 4, a spring-loaded valve 14 of the filling and dispensing head 10 is moved in the downward direction, so that an outflow aperture 15 is released and an air channel in the head 10 to the area 16 between the flexible bag 6 and the rigid container 7 is opened, which air channel is in communication with the pressure line 12.

A flexible dispensing line 17 is connected to the filling and dispensing head 10, and on placing of the pack 5 in the cooling chamber 3 is connected to a dispensing head 18. The dispensing line 17 comprises near an outflow end a shut-off valve 19, which is placed in a detachable manner in the dispensing head 18, and which has a normally closed position there. On placing of the pack 5 in the dispensing device 2 and closure of the lid 3, so that the compressor 13 is activated, the shut-off valve 19 is closed, and the beer, as a result of the pressure built up by the compressor 13 in the area 16 between the flexible bag and the rigid container, is pushed out of the flexible bag into the flexible line 17, against the shut-off valve 19. By operation of a handle 20, the shut-off valve 19, which forms an integral part of the dispensing line 17, can be opened, and the beer can be drawn out of the bag 6. When the pack 5 has been emptied, or if the pack is still partially full and another beverage pack is placed in the dispensing device, the container 7 and the flexible dispensing line 17 connected to it with the closed shut-off valve 19 can be removed from the cooling chamber 3. The container 7 of the empty pack 5, which can, for example, be moulded from plastic such as PET or ABS, can be re-used, while the flexible bag 6, the filling and dispensing head 10 and the flexible line 17 with the shut-off valve 19 may be of a disposable design, and may be thrown away or recycled after use. For further details of the beverage dispensing device 2, reference is made to International Patent Application No. PCT/NL99/00454, in the name of the applicant, the content of which is included here by reference to it.

Figure 2:
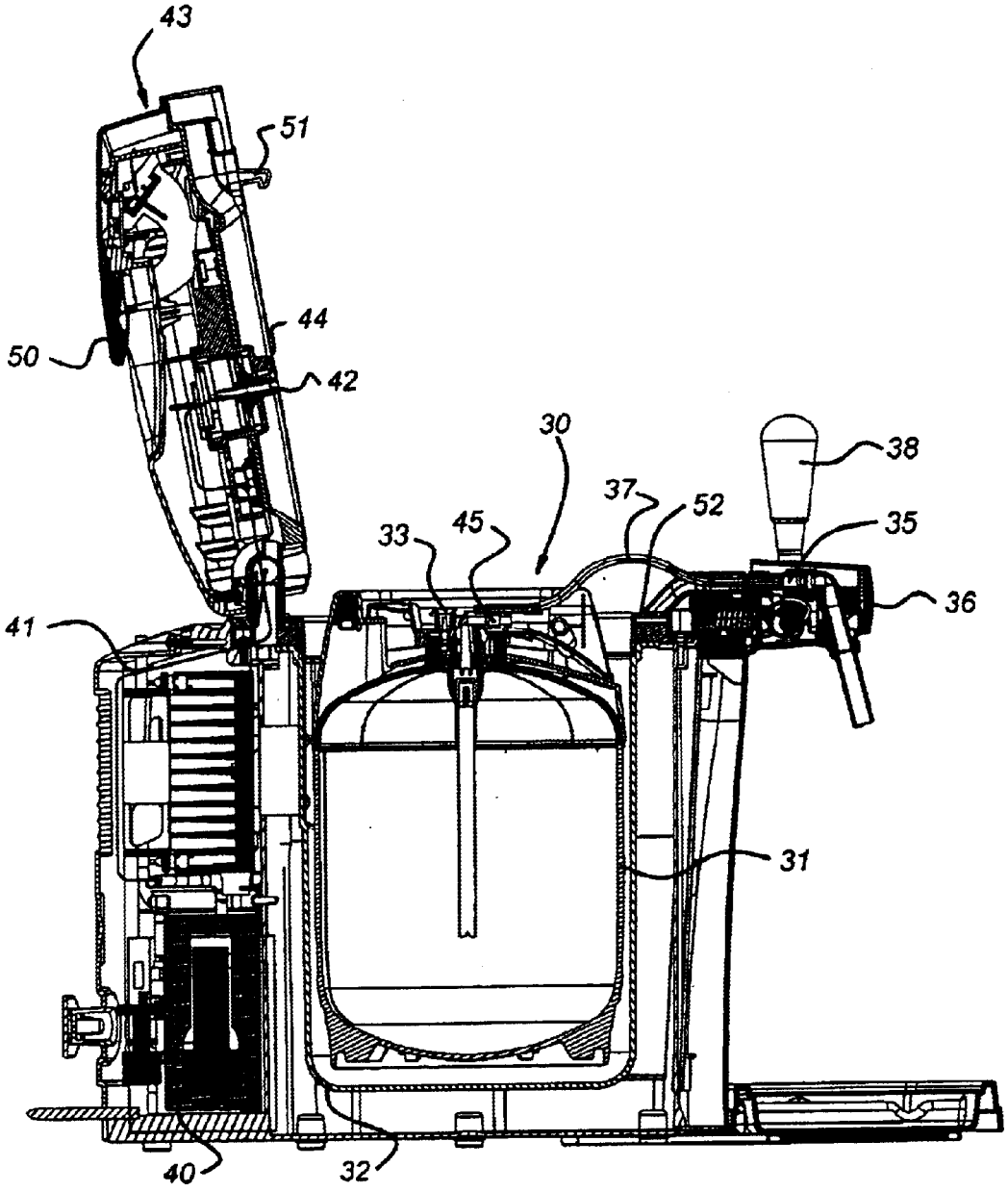
FIG. 2 shows a beverage dispensing device according to the invention, with a lid in the open position.

FIG. 2 shows the beverage dispensing device 30 according to the invention, with a beverage pack 31 accommodated in the cooling chamber 32. The pack 31 is provided on the top with an air connection 33, and with a spring-loaded shut-off valve 34. The pack 31 comprises a flexible dispensing line 37, which has on one of its ends a shut-off valve 35, which is accommodated in a dispensing head 36 of the beverage dispensing device 30. The pack 31 comprises a rigid outer casing made of plastic and a flexible bag in which the beverage is packed. By supplying air to the space between the rigid outer wall and the flexible bag by way of the air connection 33, the beverage is dispensed from the pack by way of the spring-loaded valve 34 and the flexible line 37 when a user opens the shut-off valve 35 by means of the handle 38. A compressor 40 is connected by way of a pressure line 41 to the air connection head 42 in the lid 43. When the lid 43 is closed, the air connection head 42 is brought into close engagement with the conically shaped air connection 33 of the pack 31. The lid 43 is further provided with an operating lug 44, which on closure of the lid acts upon an elbow-shaped end 45 of the flexible line 37, with the result that said elbow-shaped end is moved downwards and the spring-loaded valve 34 is opened, so that the contents of the pack 31 can flow through the line 37 to the shut-off valve 35. The lid 43 is further provided with a handle 50 and with a spring pawl 51, which on closure of the lid acts upon a fastening part 64, 64' (see FIG. 4*c*) on the top 52 of the wall of the beverage dispensing device 30.

Figure 3:
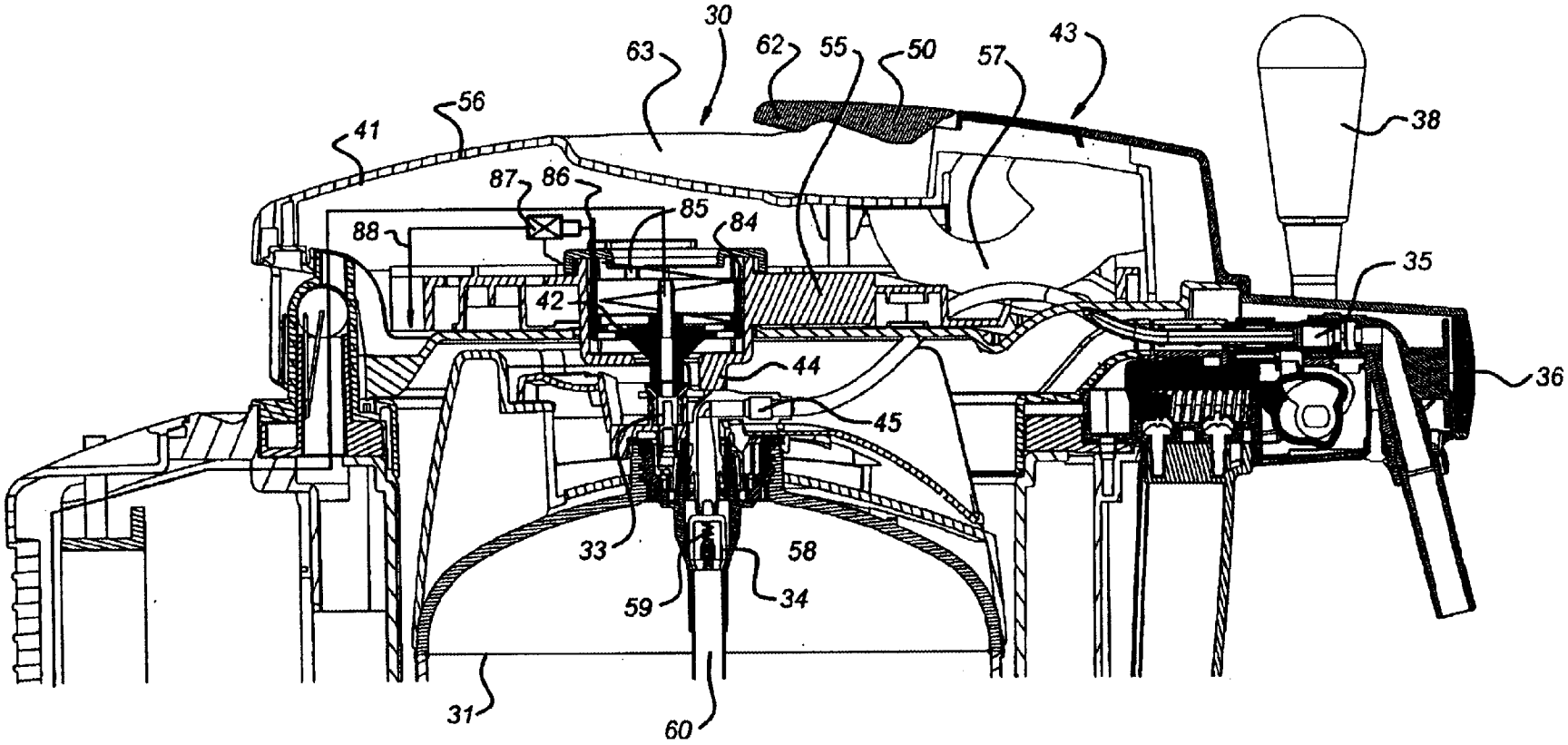
FIG. 3 shows a detail of the beverage dispensing device according to FIG. 2, with the lid in the closed position.

FIG. 3 shows a detail of the top of the beverage dispensing device 30, with the lid 43 in the closed position. FIG. 3 also shows that the air connection head 42 and the operating lug 44 form part of a bridge 55, which by means of the handle 50 is movable up and down inside the housing 56 of the lid 43. To this end, the handle 50 comprises a curved arm 57, by means of which, on placing of the handle 50 in the closing position shown in FIG. 3, the bridge 55 is moved around the rear hinge pin 70 and is pressed downwards onto the top of the pack 31. As a result of this, the connection head 42 is pressed in an airtight manner against the air connection 33 of the pack 31. The operating lug 44 moves the spring-loaded shut-off valve 34 downwards, by way of the elbow-shaped end 45, against the spring pressure of spring 59. This results in the valve 34 being released from the shutting-off surface 58, so that the contents of the pack 31 can flow by way of riser pipe 60 to the flexible dispensing line 37.

When the air connection head 42 acts upon the air connection 33, the head 42 is moved upwards against the spring pressure of coil spring 85 into a housing 84 of the bridge 55. This causes switch pin 86 to act upon a switch 87, which is connected by way of electric line 88 to the compressor 40. In the position shown in FIG. 3, the compressor is switched on by the switch 87. If no pack is present in the beverage dispensing device 30, on closure of the lid 43 the air connection head 42 will not be moved upwards against the spring pressure, so that the switch pin 86 remains in a bottom position and the switch 87 is not operated, and the compressor 40 is not activated. As a result of this, no pressure is built up in an empty dispensing device 30.

As can also be seen from FIG. 3, the shut-off valve 35 of the flexible dispensing line 37, which can be opened and closed by means of a handle 38, is accommodated in the dispensing head 36. Said dispensing head 36 comprises a housing, which in the open position of the lid 43 can be opened to place the shut-off valve 35 in it. After closure of the lid 43, the housing of the dispensing head 36 is also locked in the closed position.

The handle 50 comprises a handle part 62, which in the closed position lies above a recess 63 in the lid 43, so that the user can place his finger underneath the handle part 62 of the handle 50.

FIG. 4*a* shows the lid 43 of the dispensing device in the closed position, in a first closing phase where the user has swung the lid shut by a light movement. In this case the spring pawl 51, which is, for example, of a dual design, acts upon apertures 64, 64' in the top of the side wall 65 of the cooling chamber 32, a top view of which is shown in FIG. 4*c*. In the first closing phase, which is shown in FIG. 4*a*, the spring pawl 51 can be released by moving the handle 50 to a vertical position, so that the end 68 of the curved arm 57 presses a lug 69 of the spring pawl 51 downwards and the spring pawl 51 is placed with a light stroke in the direction of the arrow. The bridge 55 with the connection head 42 and the operating lug 44 is in a position swinging upwards. By depressing the handle 50 as shown in FIG. 4*b*, a locking lug 70 is brought into engagement with the lug 69 of the spring pawl 51, which is thereby moved in the direction of the arrow and fixed in the closed position. Furthermore, the curved arm 57 acts upon the bridge 55, which is moved downwards, so that the connection head 42 and the operating lug 44 are brought into close engagement with the air connection 33 of the pack and with the elbow-shaped element 45. As a result of this, the pressure line 41 is connected to the pack 31, and the spring-loaded valve 34 is opened, so that the contents of the pack can flow to the flexible dispensing line 37.

FIG. 5 shows a perspective view of the bridge 55, which can tilt relative to the lid 43 about the tilting axis 70, with the housing 85 and the switch 87 connected to said housing. The handle 50 is situated in the releasing position. Longitudinal arms 73, 74 of the bridge 55 are supported by way of springs 75, 76 on the bottom surface 90 of the lid 43. On the front side a lug 71, 71' of the arms 73, 74 acts upon a slot 72, 72' of the curved arms 57, 57'. The curved arms 57, 57' are connected to a connecting part 82, which is suspended in uprights 80, 81 fixed on the bottom surface 90 of the lid 43. The curved arms 57, 57' can swing through rotation of the connecting part 82 in the uprights 80, 81, so that when a user moves the arms 57, 57' downwards to the locking position the lugs 71, 71' of the longitudinal arms 73, 74 of the bridge 55 are moved downwards against the spring force of the springs 75, 76. The spring pawls 51, 51' are then released and, by expansion of the springs 77, 78, act in a spring-loaded manner upon the top edge of the cooling chamber 32. In the end locked position of the arms 57, 57', the spring pawls 51, 51' are fixed in the locked position by the slots 72, 72' and the lugs 71, 71' falling into them. On opening of the lid, the arms 57, 57' are raised so far through operation of the handle 50 that the springs 77, 78 are compressed on the spring pawls 51, 51' and the spring pawls are tilted free from the top edge of the cooling chamber 32, so that the lid can be opened.

What is claimed is:

1. Beverage dispensing device (30), provided with a chamber (32) having a bottom, a side wall and an aperture on a top side for the accommodation of a beverage container (31), with a lid (43) that is hingedly connected to the side wall and can be placed over the aperture, thereby sealing it, with a pressure device (40) that is connected to a pressure line (41) situated in the lid, and with a connecting element (42) situated on the end of the pressure line, for the purpose of connection to a beverage container (31) on closure of the lid, characterized in that the lid comprises a spring closing element (51, 51') which, when the lid swings shut, falls behind a fixing part (64, 64') of the side wall, and also comprises a handle (50, 57, 57') that can swing between a releasing and a closing position, in the case of which, by placing the handle (50, 57, 57') in the closing position with the lid closed, the connecting element (42) is moved by the handle in the direction of the bottom of the chamber (32) and is taken into engagement in a tight grip with an air inlet (33) of the beverage container (31), and the spring closing element (51, 51') is locked, and by moving the handle (50, 57, 57') to the releasing position with the lid (43) closed, the connecting element (42) is raised from the air inlet (33), and the spring closing element (51, 51') is moved to a releasing position, in which it comes away from the fixing part (64, 64').

2. Beverage dispensing device (30) according to claim 1, characterized in that the lid (43) also comprises an operating lug (44), which is movable together with the connecting element (42) by the handle (50), for the purpose of acting upon a spring-loaded shut-off valve (34) of the beverage container (31).

3. Beverage dispensing device (30) according to claim 1, characterized in that the bridge (55) comprises an arm (73, 74) that can be swung about a hinge pin (70) and has a guide element (71, 71'), the handle (50) having a curved arm (57, 57') with an engaging part (72, 72') that interacts with the guide element (71, 71'), and having a handle part (62) that in the closing position can be placed substantially parallel to the lid surface, by placing of the handle (50) in the closing position the guide element (71, 71') being moved by the engagement part and the arm (73, 74) being swung downwards about the hinge pin (70).

4. Beverage dispensing device according to claim 3, in which the lid (43) comprises a recess (63) at the position of the handle part (62), for the purpose of accommodating a user's fingers.

5. Beverage dispensing device according to claim 1, characterized in that the connecting element (42) is connected to a hinged bridge (55) by way of a part (84) that can be moved in the bridge and has a switch element (86), and a spring element (85) that presses the movable part (84)

against the bridge, while when the connecting element (42) acts upon an air inlet (33) the movable part (84) is moved against the force of the spring element (85), and the switch element (86) operates a switch (87) of the pressure device (50).

6. Beverage dispensing device (30) according to claim 1, characterized in that near the aperture said device comprises a dispensing head (36), which is connected to the side wall and has an accommodation cavity for a valve (35) of a beverage container, and has a tap handle (38) for operating the valve (35).

7. Beverage dispensing device (30) according to claim 2, characterized in that the bridge (55) comprises an arm (73, 74) that can be swung about a hinge pin (70) and has a guide element (71, 71'), the handle (50) having a curved arm (57, 57') with an engaging part (72, 72') that interacts with the guide element (71, 71'), and having a handle part (62) that in the closing position can be placed substantially parallel to the lid surface, by placing of the handle (50) in the closing position the guide element (71, 71') being moved by the engagement part and the arm (73, 74) being swung downwards about the hinge pin (70).

8. Beverage dispensing device according to claim 7, in which the lid (43) comprises a recess (63) at the position of the handle part (62), for the purpose of accommodating a user's fingers.

9. Beverage dispensing device according to claim 2, characterized in that the connecting element (42) is connected to a hinged bridge (55) by way of a part (84) that can be moved in the bridge and has a switch element (86), and a spring element (85) that presses the movable part (84) against the bridge, while when the connecting element (42) acts upon an air inlet (33) the movable part (84) is moved against the force of the spring element (85), and the switch element (86) operates a switch (87) of the pressure device (50).

10. Beverage dispensing device according to claim 3, characterized in that the connecting element (42) is connected to a hinged bridge (55) by way of a part (84) that can be moved in the bridge and has a switch element (86), and a spring element (85) that presses the movable part (84) against the bridge, while when the connecting element (42) acts upon an air inlet (33) the movable part (84) is moved against the force of the spring element (85), and the switch element (86) operates a switch (87) of the pressure device (50).

11. Beverage dispensing device according to claim 1, characterized in that the connecting element (42) is connected to a hinged bridge (55) by way of a part (84) that can be moved in the bridge and has a switch element (86), and a spring element (85) that presses the movable part (84) against the bridge, while when the connecting element (42) acts upon an air inlet (33) the movable part (84) is moved against the force of the spring element (85), and the switch element (86) operates a switch (87) of the pressure device (50).

12. Beverage dispensing device (30) according to claim 2, characterized in that near the aperture said device comprises a dispensing head (36), which is connected to the side wall and has an accommodation cavity for a valve (35) of a beverage container, and has a tap handle (38) for operating the valve (35).

13. Beverage dispensing device (30) according to claim 3, characterized in that near the aperture said device comprises a dispensing head (36), which is connected to the side wall and has an accommodation cavity for a valve (35) of a beverage container, and has a tap handle (38) for operating the valve (35).

14. Beverage dispensing device (30) according to claim 4, characterized in that near the aperture said device comprises a dispensing head (36), which is connected to the side wall and has an accommodation cavity for a valve (35) of a beverage container, and has a tap handle (38) for operating the valve (35).

15. Beverage dispensing device (30) according to claim 5, characterized in that near the aperture said device comprises a dispensing head (36), which is connected to the side wall and has an accommodation cavity for a valve (35) of a beverage container, and has a tap handle (38) for operating the valve (35).

* * * * *